United States Patent [19]

Duve

[11] Patent Number: 4,536,627

[45] Date of Patent: Aug. 20, 1985

[54] EXPANDED INTERVAL TIMER DRIVE MECHANISM

[75] Inventor: John P. Duve, Brookfield, Ill.

[73] Assignee: The Singer Company, Conn.

[21] Appl. No.: 616,032

[22] Filed: Jun. 1, 1984

[51] Int. Cl.[3] ..... H01H 43/00

[52] U.S. Cl. ..... 200/38 R; 200/35 R; 200/38 CA

[58] Field of Search ..... 200/38 R, 38 B, 38 BA, 200/38 C, 38 CA, 35 R; 74/568 T, 567, 575, 578

[56] References Cited

U.S. PATENT DOCUMENTS

| | | | |
|---|---|---|---|
| 3,603,749 | 9/1971 | Davis | 200/38 C |
| 4,153,824 | 5/1979 | Blackmond | 200/35 R |
| 4,381,433 | 4/1983 | Wagle | 200/38 R |
| 4,442,326 | 4/1984 | Wagle | 200/38 R |

*Primary Examiner*—J. R. Scott

*Attorney, Agent, or Firm*—David L. Davis; Robert E. Smith; Edward L. Bell

[57] ABSTRACT

An expanded interval drive mechanism for a program timer includes two ratchet rings. One of the ratchet rings is fixed to the monoblock and at certain regions thereon it is missing teeth over a portion of its width. Thus, the first ratchet ring has regions of narrow teeth. The other ratchet ring is arranged for free relative rotational movement in a first direction with respect to the monoblock. All of the teeth of the two ratchet rings have substantially the same major and minor diameters. However, the second ratchet ring is formed with at least one deep notch. In the region where the first ratchet ring has missing teeth, the toothless region is at substantially the same level as the notch. A single drive pawl extends over both ratchet rings and its driving surface is formed at a plurality of levels so that the drive pawl engages the first ratchet ring in the arc length corresponding to the toothless region only when the drive pawl engages the notch of the second ratchet ring. Otherwise, in this toothless region the drive pawl only advances the second ratchet ring, thereby providing an expanded interval.

9 Claims, 10 Drawing Figures

EXPANDED INTERVAL TIMER DRIVE MECHANISM

DESCRIPTION

BACKGROUND OF THE INVENTION

This invention relates to program timers and, more particularly, to a drive mechanism for such a timer which has the facility for providing long time intervals at selected locations in the program.

Program timers such as those utilized on clothes washing machines, dishwashers, or other appliances, generally have a sequence control cam drum or disc which is advanced in a step by step manner at timed intervals. The control cam drum, or disc, has various cams for sequencing the program function switches. Generally, the angular steps of the control cam drum range from 4° to 7½°. Thus, only 48 to 90 steps are available in a complete revolution of the timing cam and obviously only one revolution is available since the programs then begin to repeat.

There is an increasing demand for various programs for different washing cycles. Thus, there is pressure on the timer designer to provide more programs within the 360° rotation of the timing cam. In addition, there is opposing pressure to provide for long soak or delay periods, or the like, which normally consume a considerable number of steps in the timing advance sequence.

It is therefore a primary object of this invention to provide a program timer which is capable of providing long intervals while still being able to provide a number of programs on the timing cam.

SUMMARY OF THE INVENTION

The foregoing and additional objects are attained in accordance with the principles of this invention by providing a program timer having a plurality of timing cams located on a rotating member and controlling the operation of switches in a predetermined program characterized by a first ratchet ring mounted on the rotating member for movement therewith, the first ratchet ring having a first band of ratchet teeth over a first portion of its width and a second band of ratchet teeth over the remainder of its width, the ratchet teeth of the first band having uniform root and tip levels, the second band having at least one region with no ratchet teeth and being at a level below the root level of the ratchet teeth of the first band, the remainder of the second band having ratchet teeth which are coextensive with the ratchet teeth of the first band, a second ratchet ring coupled to the rotating member for free relative rotational movement in a first direction with respect to the rotating member, the second ratchet ring being in axial alignment with the first ratchet ring, the ratchet teeth of the second ratchet ring having uniform tip and root levels, the second ratchet ring being formed with at least one notch at a level below the root level of the second ratchet ring teeth and substantially the same as the level of the toothless region of the second band of the first ratchet ring, and a drive pawl selectively engaging the first and second ratchet rings to selectively drive same in the first direction, the drive pawl engaging the first ratchet ring in the arc length corresponding to the toothless region only when the drive pawl engages the notch of the second ratchet ring.

In accordance with an aspect of this invention, the drive pawl has a driving surface extending toward the center of the rotating member to a plurality of levels, a first of the levels extending only across the first band of the first ratchet ring, the remainder of the levels being closer to the center of the rotating member than the first band.

BRIEF DESCRIPTION OF THE DRAWINGS

The foregoing will be more readily apparent upon reading the following description in conjunction with the drawings in which like elements in different figures thereof have the same reference character applied thereto and wherein.

DETAILED DESCRIPTION

Figure 1:
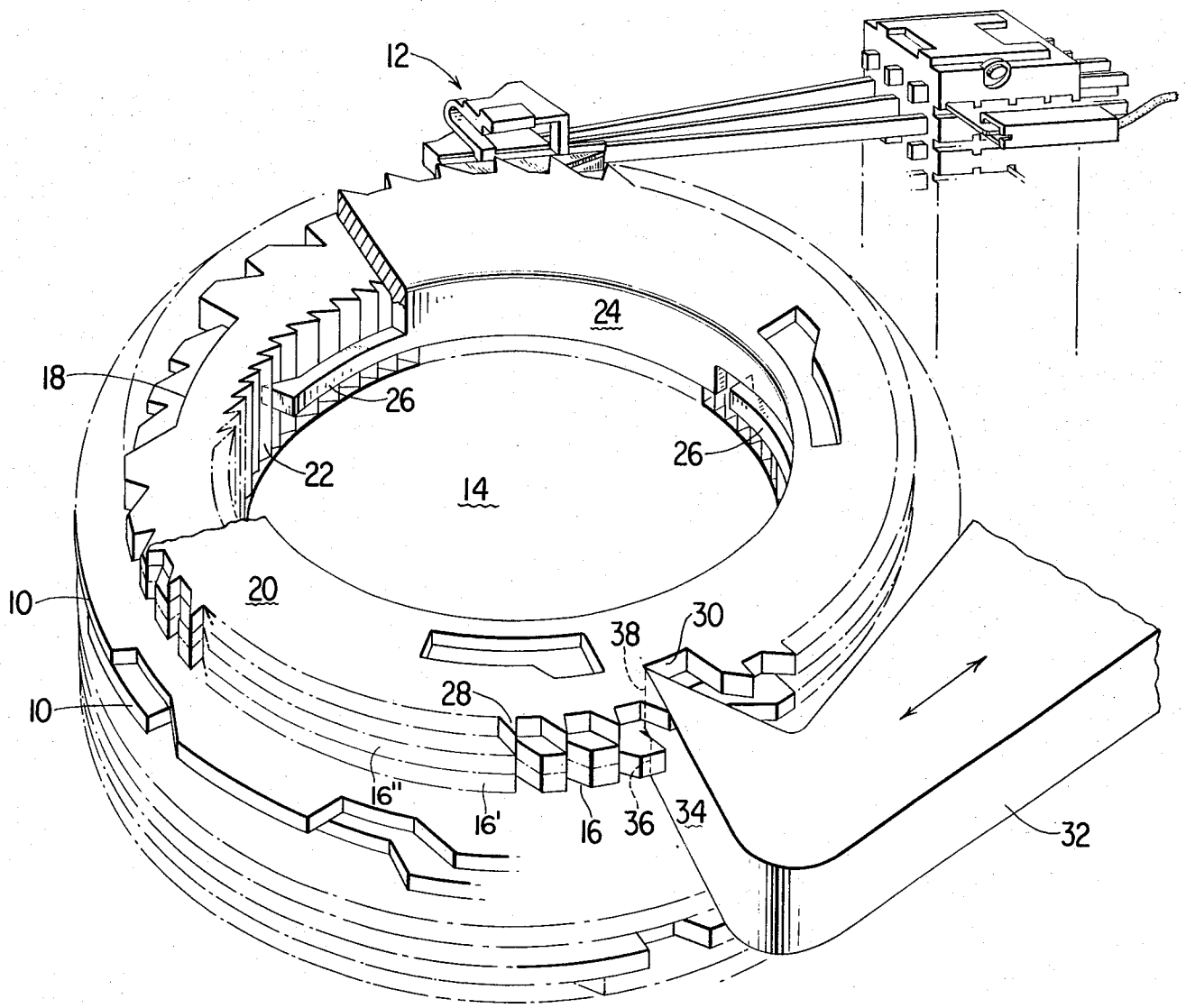
FIG. 1 is a partially broken away perspective illustration of a portion of a program timer showing a first embodiment of this invention incorporated therein.

Referring now to FIG. 1, shown therein are the relevant portions of a program timer necessary for an understanding of the present invention. Thus, the program timer includes a plurality of timing cams 10 located on a rotating member for controlling the operation of switches 12 in a predetermined program, as is conventional in the art. In particular, the rotating member is a hollow cam drum 14, sometimes referred to as a monoblock. The details of the monoblock 14 with respect to the timing cams 10 and the switches 12 are well known in the art and form no part of the present invention.

The present invention is concerned with a mechanism for driving the monoblock 14 which provides the facility for delaying or lengthening the time interval between steps of advancing the monoblock 14. Accordingly, there is provided a first ratchet ring 16 mounted on the monoblock 14 for movement therewith. Preferably, the monoblock 14 is a unitary integrally molded piece and the first ratchet ring 16 is a part thereof., The first ratchet ring 16 is formed as a first band 16' of ratchet teeth over a first portion of its width and a second band 16" of ratchet teeth over the remainder of its width. As viewed in FIG. 1, the first band 16' of ratchet teeth is on the lower half of the first ratchet ring 16 and the second band 16" of ratchet teeth constitutes the upper half of the first, ratchet ring 16. The ratchet teeth of the first band 16' have uniform root and tip levels. The second band 16 " has at least one region 18 with no ratchet teeth. The level of the region 18 is below the, root level of the ratchet teeth of the first band 16 '. Other than the region 18, the remainder of the second band 16" has ratchet teeth which are aligned and level, so as to be coextensive, with the ratchet teeth of the first band 16'.

In accordance with a first embodiment of this invention, a second ratchet ring 20 is coupled to the monoblock 14 for free relative rotational movement in a first direction with respect to the monoblock 14. This is accomplished by providing an internal ring of inwardly extending regularly spaced ratchet teeth 22 substantially underlying the first ratchet ring 16. The second ratchet ring 20 includes a sleeve 24 extending laterally therefrom. Formed on the sleeve 24 are a plurality of finger elements 26, at least three in number, which engage the internal ratchet teeth 22 to act as a one-way clutch between the second ratchet ring 20 and the monoblock 14. The second ratchet ring 20, along with the sleeve 24 and finger elements 26, is preferably formed as a unitary integrally molded piece, with the finger elements 26 being sufficiently flexible so that the second ratchet ring 20 can be freely moved in the clockwise direction with respect to the monoblock 14, as viewed in FIG. 1, but cannot be moved counterclockwise with respect thereto. Thus, the fingers 26 act both to hold the second ratchet ring 20 in axial alignment with the first ratchet ring 16 and also act as a one-way clutch. As will become apparent from the following discussion, this one-way clutch arrangement eliminates the necessity for having a separate stop pawl for the second ratchet ring 20.

The second ratchet ring 20 is formed with regularly spaced ratchet teeth 28 having uniform tip and root levels. The second ratchet ring 20 is further formed with at least one notch 30 at a level below the root level of the teeth 28 and substantially the same as the level of the toothless region 18 of the second band 16'' of the first ratchet ring 16.

To drive the monoblock 14 so as to sequence the operation of the switches 12 in accordance with the program embedded on the timing cams 10 there is provided a drive pawl 32 which is linearly reciprocated. Linear reciprocation of the drive pawl 32 may be effected in many different ways and the particular mechanism for driving the pawl 32 does not form a part of the present invention. The drive pawl 32 is arranged to selectively engage the first ratchet ring 16 and the second ratchet ring 20 to selectively drive these rings in the clockwise direction, as viewed in FIG. 1. To provide the delayed start or expanded interval, the drive pawl 32 is adapted to engage the first ratchet ring 16 in the arc length corresponding to the toothless region 18 only when the drive pawl engages the notch 30 of the second ratchet ring 20. Thus, the drive pawl 32 is formed with a driving surface 34 which extends toward the center of the monoblock 14 to two levels 36 and 38. The first level 36 extends only across the first band 16' of the first ratchet ring 16 and the second level 38 extends across the second band 16'' of the first ratchet ring 16 as well as across the second ratchet ring 20. The second level 38 is closer to the center of the monoblock 14 than is the first level 36, with the difference between the first level 36 and the second level 38 being such that the drive pawl 32 engages a tooth of the first band 16' of the first ratchet ring 16 only when the driving surface 34 is within both the notch 30 of the second ratchet ring 20 and the toothless region 18 of the second band 16'' of the first ratchet ring 16.

Figure 2A:
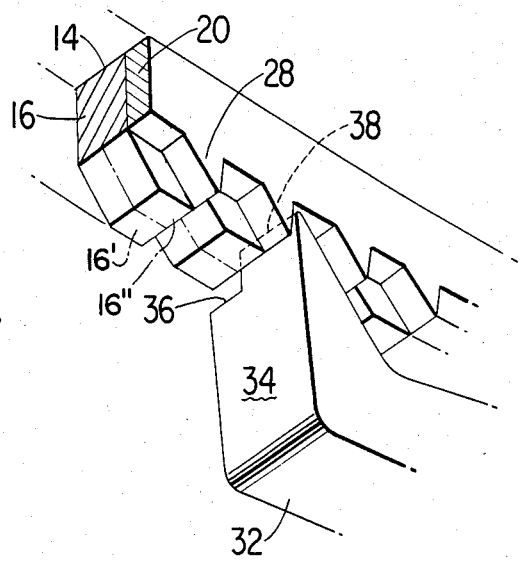
FIGS. 2A, 2B and 2C are partial perspective illustrations showing different stages of operation of the drive mechanism shown in FIG. 1.
Figure 2B:
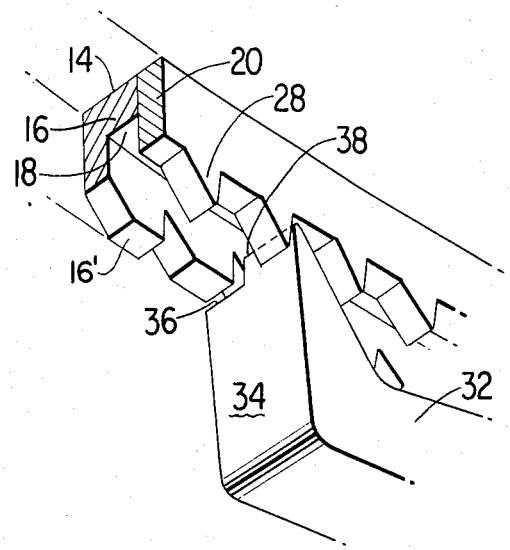
Figure 2C:
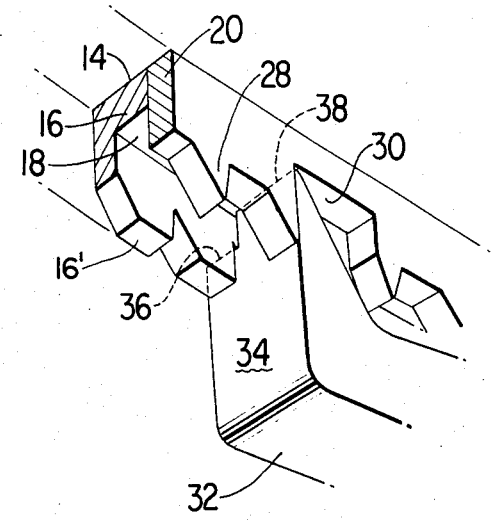
Figure 3:
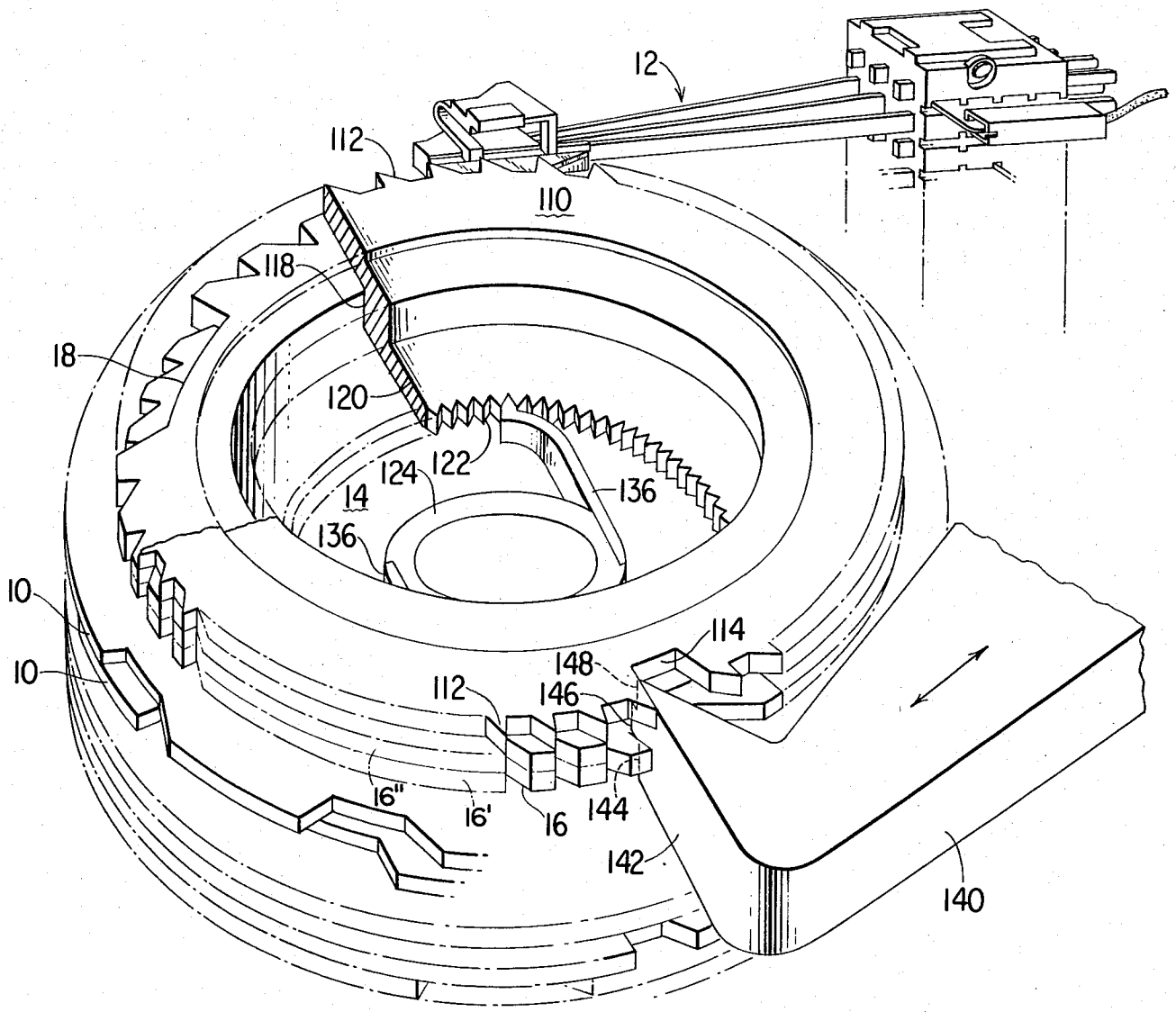
FIG. 3 is a partially broken away perspective illustration of a portion of a program timer showing a second embodiment of this invention incorporated therein.

Referring now to FIGS. 2A, 2B and 2C, the driving operation according to the first embodiment of this invention will be described. FIG. 2A illustrates the condition where "normal speed" of advancement of the monoblock 14 takes place. As shown in FIG. 2A, the driving surface 34 engages the first ratchet ring 16 in a region where the ratchet teeth of the first ratchet ring 16 extend across both the first and second bands 16' and 16''. Under these conditions, as shown in FIG. 2A, the second level 38 of the driving surface 34 engages the second band 16'' of the first ratchet ring 16 as well as the second ratchet ring to advance both the monoblock 14 and the second ratchet ring 20.

FIG. 2B illustrates the condition where it is desired to have an expanded interval and the monoblock 14 is "stalled". When it is desired to have such an expanded interval, the second band 16'' of the first ratchet ring 16 is formed with the toothless region 18. When the driving surface 34 of the drive pawl 32 is within this toothless region 18, the second level 38 engages a tooth of the second ratchet ring 20 but does not engage any teeth of the first ratchet ring 16. The first level 36 is sufficiently removed from the second level 38 that is passes over the teeth of the first band 16' of the first ratchet ring 16 so that only the second ratchet ring 20 is advanced. This advance of the second ratchet ring 20 without any advancement of the monoblock 14 continues until the second ratchet ring 20 is advanced to a point where the driving surface 34 of the drive pawl 32 drops into a notch 30, as illustrated in FIG. 2C. When this occurs, the first level 36 of the driving surface 34 moves inward, sufficiently that it engages a tooth of the first band 16' of the first ratchet ring 16, advancing the monoblock 14 along with the second ratchet ring 20. At the next stroke of the drive pawl 32, if the driving surface 34 is still within the toothless region 18, the condition will again be as illustrated in FIG. 2B and the monoblock 14 will again be stalled until the second ratchet ring 20 is advanced to another, or the same, notch 30. However, if this next stroke of the drive pawl 32 had, moved the monoblock 14 into a region where the second band 16'' of the first ratchet ring 16 has teeth, the condition will be as depicted in FIG. 2A and the monoblock 14 will be thereafter advanced along with the second ratchet ring 20 until another toothless region 18 is present for another expanded interval.

To prevent reverse movement of the monoblock 14 and the second ratchet ring 20 a stop, or anti-reverse, pawl (not shown) is provided. This stop pawl engages the teeth of the first band 16' of the first ratchet ring 16. Since the second ratchet ring 20 is one way clutched to the first ratchet ring 16, a separate stop pawl for the second ratchet ring 16 is not required.

FIGS. 3, 4A, 4B, 4C, 5 and 6 illustrate a second embodiment of this invention. In accordance with the second embodiment, a second ratchet ring 110 is provided. This second ratchet ring 110 is formed with regularly spaced ratchet teeth 112 having uniform tip and root levels, and is further formed with at least one notch 114 at a level below the root level of the teeth 112 and substantially the same as the level of the toothless region 18 of the second band 16'' of the first ratchet ring 16. Thus, the outer periphery of the second ratchet ring 110 of this second embodiment is the same as the outer periphery of the second ratchet ring 20 of the first embodiment.

However, in this second embodiment, the second ratchet ring 110 is not coupled to the monoblock 14. Instead, the second ratchet ring 110 is free to rotate with respect to the monoblock 14. The second ratchet ring 110 is formed with a laterally extending sleeve 118 from which an inwardly extending ring 120 depends. The sleeve 118 fits inside the hollow monoblock 14 so that the second ratchet ring 110 is freely rotatable with respect thereto. The inner periphery of the ring 120 is formed with a plurality of circumferential regularly spaced indentations, preferably in the form of saw teeth 122. In accordance with this second embodiment, a spring member 124 is provided. The spring member 124 has a circular hub region 126 having a plurality of laterally extending tabs 128. The tabs 128 are formed with outwardly flaring ears 130 adapted for one-way insertion through spaced apertures 132 in the front plate 134 of the program timer. The spring 124 is thereby mounted on the front wall 134. A pair of resilient finger elements 136 extends outwardly from the spring member 124. The distal ends of the finger elements 136 are formed in a complementary manner with respect to the saw teeth 122 for mating therewith. Accordingly, while the second ratchet ring 110 is free to rotate with respect to the monoblock 14, this rotation takes place in a detented manner, due to the cooperation between the resilient finger elements 136 and the saw teeth 122. Additionally, this cooperation provides a resistance to rotation of the second ratchet ring 110 which, as will become clear from the following discussion, eliminates the need for a stop pawl for the second ratchet ring 110. Although a particular detent arrangement is illustrated, other detent arrangements may also be utilized.

As with the first embodiment, in the second embodiment a linearly reciprocated drive pawl 140 is provided to drive the monoblock 14 so as to sequence the operation of the switches 12 in accordance with the program embedded on the timing cams 10. The drive pawl 140 is arranged to selectively engage the first ratchet ring 16 and the second ratchet ring 110 to selectively drive these rings in the clockwise direction, as viewed in FIG. 3. To provide the delayed start or expanded interval, the drive pawl 140 is adapted to engage the first ratchet ring 16 in the arc length corresponding to the toothless region 18 only when the drive pawl 140 engages the notch 114 of the second ratchet ring 110. Thus, the drive pawl 140 is formed with a driving surface 142 which extends toward the center of the monoblock 14 to three levels 144, 146 and 148. The first level 144 extends only across the first band 16' of the first ratchet ring 16, the second level 146 extends only across the second band 16" of the first ratchet ring 16, and the third level 148 extends only across the second ratchet ring 110. The third level 148 is closer to the center of the monoblock 14 than is the first level 144, and the second level 146 is closer to the center than the third level 148. The difference between the levels 144, 146 and 148 is such that, the drive pawl 140 engages a tooth of the first band ≠' of the first ratchet ring 16 only when the driving surface 142 is within both the notch 114 of the second ratchet ring 110 and the toothless region 18 of the second band 16" of the first ratchet ring 16.

Figure 4A:
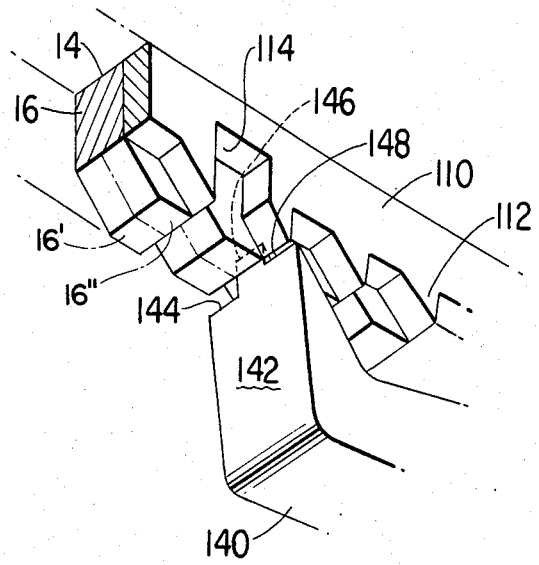
FIGS. 4A, 4B and 4C are partial perspective illustrations showing different stages of operation of the drive mechanism shown in FIG. 3.
Figure 4B:
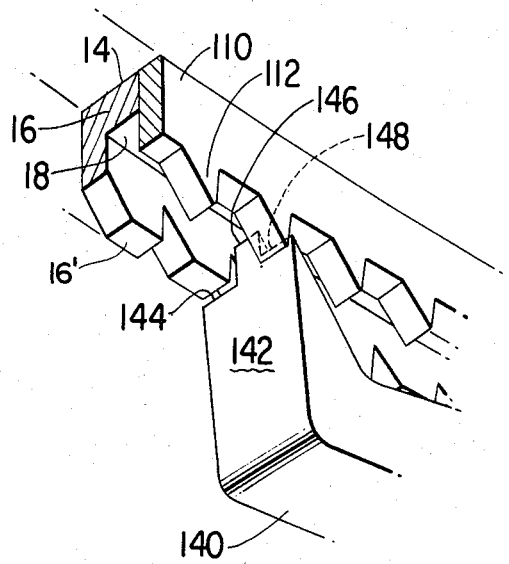
Figure 4C:
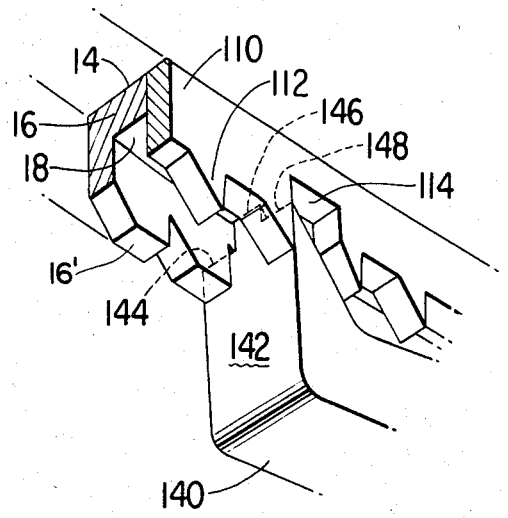
Figure 6:
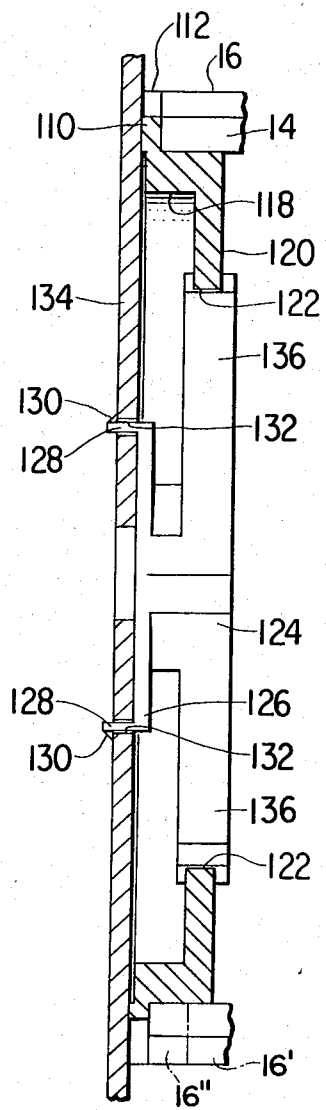
FIG. 6 is a cross-sectional view taken substantially along the line 6—6 in FIG. 5.
Figure 5:
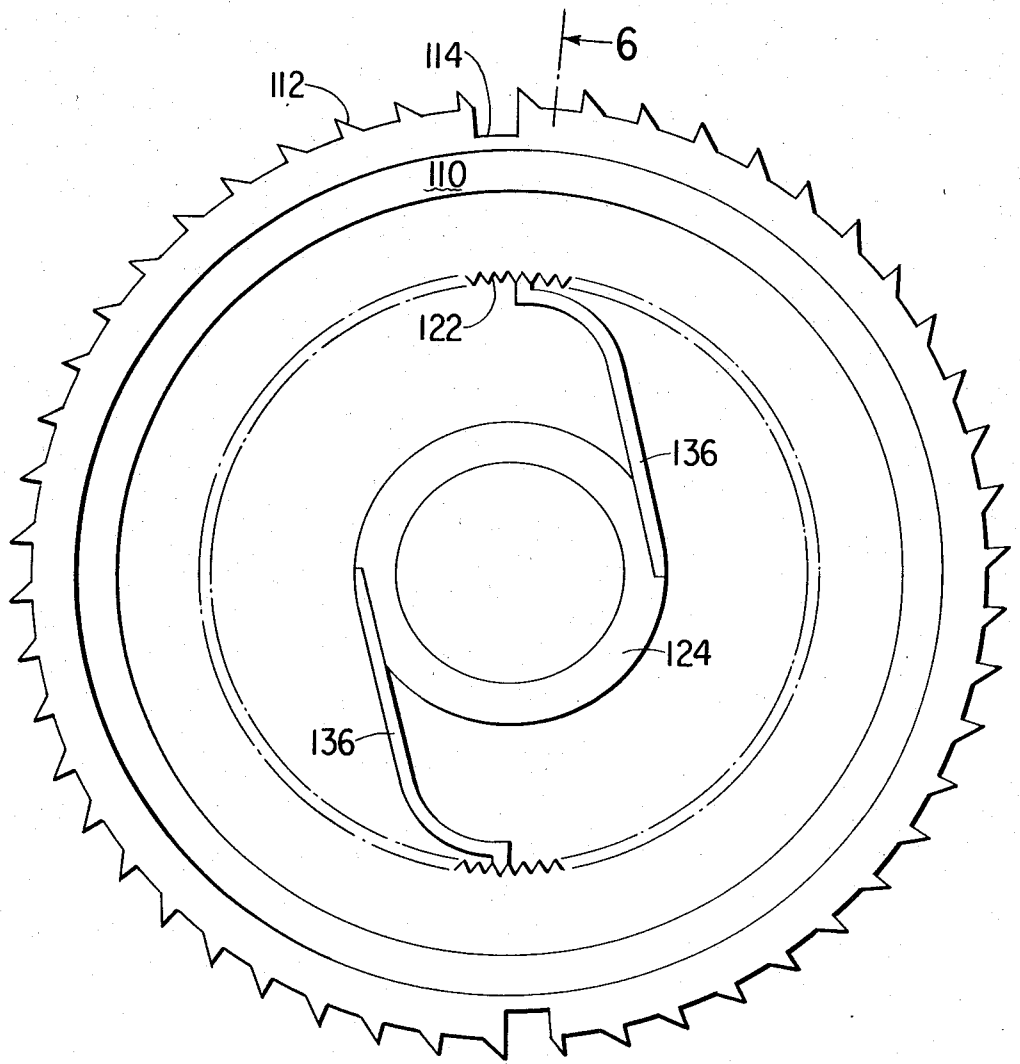
FIG. 5 is a plan view of the second ratchet ring of the mechanism shown in FIG. 3 as viewed through the front plate of the program timer.

Referring now to FIGS. 4A, 4B and 4C, the driving operation according to the second embodiment of this invention will be described. FIG. 4A illustrates the condition where "normal speed" of advancement of the monoblock 14 takes place. As shown in FIG. 4A, the driving surface 142 engages the first ratchet ring 16 in a region where the ratchet teeth of the first ratchet ring 16 extend across both the first and second bands 16' and 16". Under these conditions, as shown in FIG. 4A, the second 146 of the driving surface 142 engages the second band 16" of the first ratchet ring 16. The third level 148 is sufficiently removed from the second level 146 that it passes over the teeth 112 of the second ratchet ring 110 so that the second ratchet ring is not advanced during this time. The detent action of the finger elements 136 and the teeth 122 prevent movement of the second ratchet ring 110 due to any sliding friction between the monoblock 14 and the second ratchet ring 110.

FIG. 4B illustrates the condition where it is desired to have an expanded interval and the monoblock 14 is "stalled". When it is desired to have such an expanded interval, the second band 16" of the first ratchet ring 16 is formed with the toothless region 18. When the driving surface 142 of the drive pawl 140 is within this toothless region 18, the second level 146 does not engage any teeth but allows the drive pawl 140 to drop down sufficiently that the third level 148 engages a tooth of the second ratchet ring 110. However, the drive pawl 140 does not drop enough to allow, the first level 144 to engage a tooth of the first band 16' of the first ratchet ring 16 so only the second ratchet ring 110 is advanced. This advance of the second ratchet ring 110 without any advancement of the monoblock 14 continues until the second ratchet ring 110 is advanced to a point where the driving surface 142 of the drive pawl 140 drops into a notch 114, as illustrated in FIG. 4C. When this occurs, the first level 144 of the driving surface 142 moves inward,sufficiently that it engages a tooth of the first band 16' of the first ratchet ring 16, advancing the monoblock 14 along with the second ratchet ring 110. At the next stroke of the drive pawl 140, if the driving surface 142 is still within the toothless region 18, the condition will again be as illustrated in FIG. 4B and the monoblock 14 will again be stalled until the second ratchet ring 110 is advanced to another, or the same, notch 114. However, if this next stroke of the drive pawl 140 had moved the monoblock 14 into a region where the second band 16" of the first ratchet ring 16 has teeth, the condition will be as depicted in FIG. 4A and the monoblock 14 will be thereafter advanced until another toothless region 18 is present for another expanded interval.

A significant difference between this second embodiment and the first embodiment is that in the second embodiment during normal advancement of the monoblock 14, the second ratchet ring remains stationary, with a notch 114 just forward of the drive pawl 140, as shown in FIG. 4A. Accordingly, every time that a toothless region 18 is encountered, the second ratchet ring 110 is in a predictable position so that there is a predictable number of strokes of the drive pawl 140 until the next notch 114 is encountered to advance the monoblock 14.

Accordingly, there have been disclosed embodiments of an interval expansion timer drive mechanism. It is understood that the above-described embodiments are merely illustrative of the application of the principles of this invention. Numerous other embodiments may be devised by those skilled in the art without departing from the spirit and scope of this invention, as defined by the appended claims.

I claim:

1. A program timer having a plurality of timing cams located on a rotating member and controlling the operation of switches in a predetermined program characterized by:

a first ratchet ring mounted on said rotating member for movement therewith, said first ratchet ring having a first band of ratchet teeth over a first portion of its width and a second band of ratchet teeth over the remainder of its width, the ratchet teeth of said first band having uniform root and tip levels, said second band having at least one region with no ratchet teeth and being at a level below the root level of the ratchet teeth of said first band, the remainder of said second band having ratchet teeth which are coextensive with the ratchet teeth of said first band;

a second ratchet ring arranged for free relative rotational movement in a first direction with respect to said rotating member, said second ratchet ring being in axial alignment with said first ratchet ring, the ratchet teeth of said second ratchet ring having uniform tip and root levels, said second ratchet ring being formed with at least one notch at a level below the root level of the second ratchet ring teeth and substantially the same as the level of the toothless region of said second band of said first ratchet ring; and a drive pawl selectively engaging said first and second ratchet rings to selectively drive same in said first direction, said drive pawl engaging said first ratchet ring in the arc length corresponding to said toothless region only when said drive pawl engages said notch of said second ratchet ring.

2. A program timer according to claim 1 further characterized by said drive pawl having a driving surface extending toward the center of said rotating member to a plurality of levels, a first of said levels extending only across said first band of said ratchet ring, the others of said levels being closer to said center of said rotating member than said first level.

3. A program timer according to claim 1 further characterized by said drive pawl having a driving surface extending toward the center of said rotating member to two levels, a first of said levels extending only across, said first band of said first ratchet ring and the second of said levels extending across said second band of said first ratchet ring and said second ratchet ring.

4. A program timer according to claim 3 further characterized by said second level of said drive pawl being closer to said center of said rotating member than said first level, the difference between said first and second levels being such that said drive pawl engages a tooth of said first band only when said driving surface is within both said notch of said second ratchet ring and said toothless region of said second band of said first ratchet ring.

5. A program timer according to claim 1 wherein said rotating member is formed as a hollow cam drum, further characterized in that said rotating member includes an internal ring of inwardly extending regularly spaced ratchet teeth substantially underlying said first ratchet ring and said second ratchet ring includes a plurality of outwardly extending finger elements spaced inwardly from and laterally of the ratchet teeth of said second ratchet ring and adapted to engage the ratchet teeth of said internal ring to act as a one-way clutch between said second ratchet ring and said rotating member.

6. A program timer according to claim 5 further characterized in that said second ratchet ring includes a sleeve extending laterally from said second ratchet ring and said finger elements are mounted on said sleeve.

7. A program timer according to claim 1 further characterized by said drive pawl having a driving surface extending toward the center of said rotating member to three levels, a first of said levels extending only across said first band of said first ratchet ring, a second of said levels extending only across said second band of said first ratchet ring, and the third of said levels extending only across said second ratchet ring.

8. A program timer according to claim 7 further characterized by said third level of said drive pawl being closer to said center of said rotating member than said first level and said second level being closer to said center than said third level, the difference between said levels being such that said drive pawl engages a tooth of said first band only when said driving surface is within both said notch of said second ratchet ring and said toothless region of said second band of said first ratchet ring.

9. A program timer according to claim 1 further characterized in that said second ratchet ring is rotatably independent of said rotating member, and is formed with a plurality of circumferential regularly spaced indentations, and further including a spring member mounted on a stationary wall of said program timer and cooperating with said indentations so as to provide a detent action for said second ratchet ring and prevent rotation of said second ratchet ring during the return stroke of said drive pawl.

* * * * *